US006798314B2

(12) United States Patent
Nation

(10) Patent No.: US 6,798,314 B2
(45) Date of Patent: Sep. 28, 2004

(54) TRANSMIT/RECEIVE COMBINER USING SHUNT ADMITTANCE ELEMENTS FOR ISOLATION

(75) Inventor: Med A. Nation, Scottsdale, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/330,386

(22) Filed: Dec. 26, 2002

(65) Prior Publication Data

US 2004/0124944 A1 Jul. 1, 2004

(51) Int. Cl.[7] ..... H01P 1/10
(52) U.S. Cl. ..... 333/104; 333/26; 333/101; 333/124
(58) Field of Search ..... 333/25, 26, 101, 333/103, 104, 124, 125, 126, 127, 128, 129; H01P 1/15

(56) References Cited

U.S. PATENT DOCUMENTS 5,159,297 A * 10/1992 Tateno ..... 333/104
5,909,641 A * 6/1999 Simmons ..... 455/78
6,600,776 B1 * 7/2003 Alamouti et al. ..... 375/147

* cited by examiner

*Primary Examiner*—Robert Pascal
*Assistant Examiner*—Dean Takaoka
(74) *Attorney, Agent, or Firm*—Kenneth J. Cool

(57) ABSTRACT

Briefly, in accordance with one embodiment of the invention, a combiner may include transmission lines to couple a receive port and a transmit port to an antenna at a common junction. Shunt admittance elements may be utilized at the transmit and the receive ports to isolate one of the transmit and the receive ports from the antenna by shunting the at least one of the transmit and the receive ports to a power supply potential such as a ground reference. During a transmit mode, the shunt admittance element at the receive port may shunt the receive port to the power supply potential, thereby isolating the receive port from the antenna. During a receive mode the shunt admittance element at the transmit port may shunt the transmit port to the power supply potential, thereby isolating the transmit port from the antenna.

8 Claims, 3 Drawing Sheets

TRANSMIT/RECEIVE COMBINER USING SHUNT ADMITTANCE ELEMENTS FOR ISOLATION

DESCRIPTION OF THE DRAWING FIGURES

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
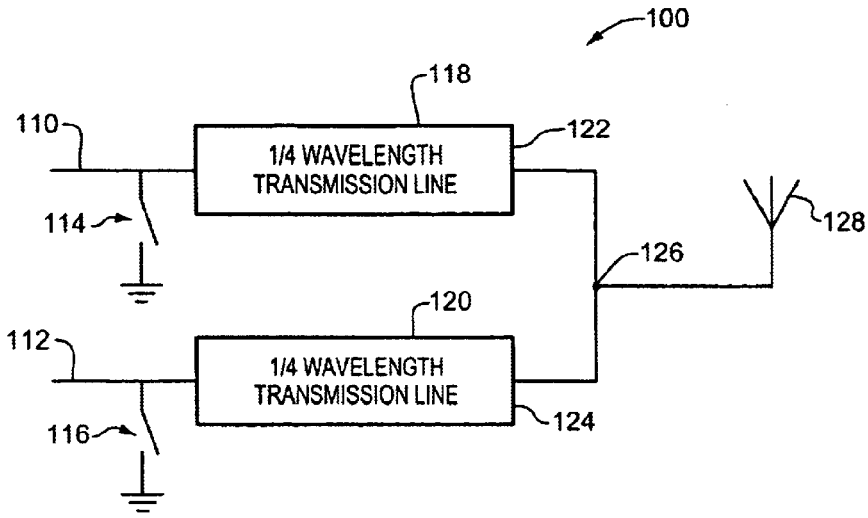
FIG. 1 is schematic diagram of a combiner in accordance with one embodiment of the present invention.

It will be appreciated that for simplicity and clarity of illustration, elements illustrated in the figures have not necessarily been drawn to scale. For example, the dimensions of some of the elements are exaggerated relative to other elements for clarity. Further, where considered appropriate, reference numerals have been repeated among the figures to indicate corresponding or analogous elements.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

Some portions of the detailed description that follows are presented in terms of algorithms and symbolic representations of operations on data bits or binary digital signals within a computer memory. These algorithmic descriptions and representations may be the techniques used by those skilled in the data processing arts to convey the substance of their work to others skilled in the art.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

It should be understood that embodiments of the present invention may be used in a variety of applications. Although the present invention is not limited in this respect, the circuits disclosed herein may be used in many apparatuses such as in the transmitters and receivers of a radio system. Radio systems intended to be included within the scope of the present invention include, by way of example only, cellular radiotelephone communication systems, satellite communication systems, two-way radio communication systems, one-way pagers, two-way pagers, personal communication systems (PCS), personal digital assistants (PDA's) and the like.

Types of cellular radiotelephone communication systems intended to be within the scope of the present invention include, although not limited to, Code Division Multiple Access (CDMA) cellular radiotelephone communication systems, Global System for Mobile Communications (GSM) cellular radiotelephone systems, North American Digital Cellular (NADC) cellular radiotelephone systems, Time Division Multiple Access (TDMA) systems, Extended-TDMA (E-TDMA) cellular radiotelephone systems, third generation (3G) systems like Wide-band CDMA (WCDMA), CDMA-2000, and the like.

Figure 4:
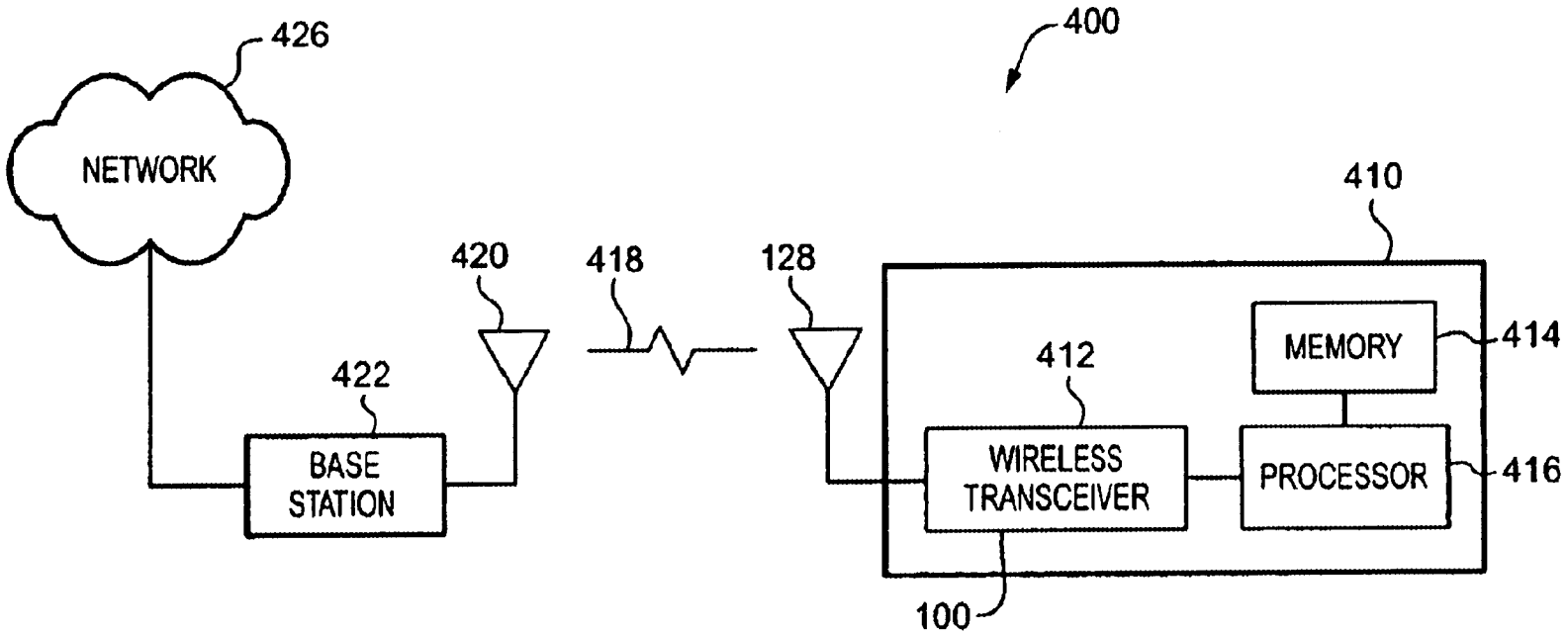
FIG. 4 is a block diagram of a wireless communication system in accordance with an embodiment of the present invention.

Referring now to FIG. 1, a schematic diagram of a combiner in accordance with one embodiment of the present invention will be discussed. A combiner 100 may combine separate transmit and receive ports 110 and 112 operating in the same frequency band to a common antenna 128. The frequency of design and operation may be a microwave or radio-frequency, for example in the range of up to 10 GHz, although the scope of the invention is not limited in this respect. A receive port 110 may couple to antenna 128 using a quarter wavelength transmission line 118. Likewise, a transmitter port 112 may couple to antenna 128 using a quarter wavelength transmission line 120. Quarter wavelength transmission lines 118 and 120 may couple to antenna 128 at a common junction 126, although the scope of the invention is not limited in this respect. Receive port 110 may couple to an input of a receiver amplifier (not shown) such as a low noise amplifier (LNA), and transmit port 112 may couple to an output of a transmitter power amplifier (not shown). In one embodiment of the invention, combiner 110 may be incorporated into a transceiver of a wireless device such as shown in FIG. 4, although the scope of the invention is not limited in this respect.

In accordance with one embodiment of the invention, a shunting admittance element 114 may isolate receive port 110 from antenna 128 by shunting receive port 110 to a power supply potential such as a ground reference so as to provide a path for transmission from transmit port 112 to antenna 128. Likewise, shunting admittance element 116 may isolate transmit port 112 from antenna 128 by shunting transmit port 112 to a power supply potential such as a ground reference so as to provide a path for receiving from antenna 128 to receive port 112. In one embodiment of the invention, shunting admittance elements 114 and 116 may provide a high admittance or short circuit in one state, and a low admittance or open circuit in another state, and may be for example a complementary metal oxide semiconductor (CMOS) transistor, although the scope of the invention is not limited in this respect.

When quarter wavelength transmission lines 118 and 120 are shunted at one end by shunt admittance elements 114 and 116, the resulting short circuit at the one end may be translated into an open circuit at the other end 122 and 124 at the desired operating frequency. Such an arrangement allows for isolation of receive port 110 and transmit port 112 from antenna 129 when the associated shunting admittance element 114 or 116 provides a short circuit to ground. Furthermore, when shunting admittance elements 114 and 116 are in an open circuit state, lower insertion loss may result thereby allowing for a lower transmitter impedance, for example lower than the impedance of antenna 128, and also allowing for a lower receiver noise figure, although the scope of the invention is not limited in this respect.

Figure 2:
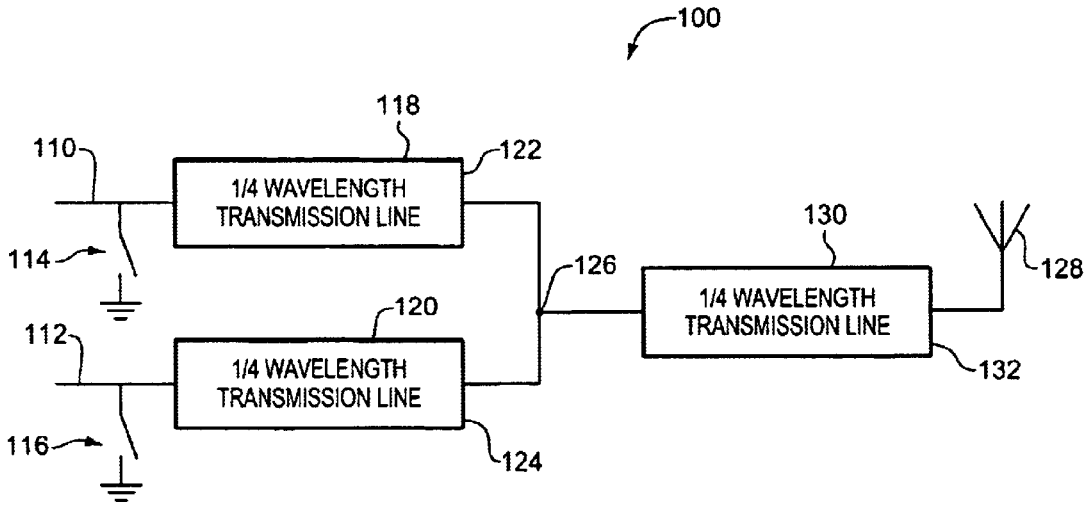
FIG. 2 is a schematic diagram of a combiner that includes an impedance transformer in accordance with one embodiment of the present invention.

Referring now to FIG. 2, a schematic diagram of a combiner that includes an impedance transformer in accordance with one embodiment of the present invention will be discussed. The combiner 100 of FIG. 2 may be similar to the combiner 100 of FIG. 1 with an added impedance transformer 130 to match the output impedance of a transmitter coupled to transmit port 112, and the input impedance of a receiver coupled to receive port 110, to the impedance of antenna 128. In one embodiment of the invention, impedance transformer 130 may include a quarter wavelength transmission line to provide impedance matching at the desired operating frequency, although the scope of the invention is not limited in this respect. Such a configuration may allow for variation in antenna impedance where the antenna impedance may vary from the impedances of the transmitter and the receiver, although the scope of the invention is not limited in this respect.

Figure 3:
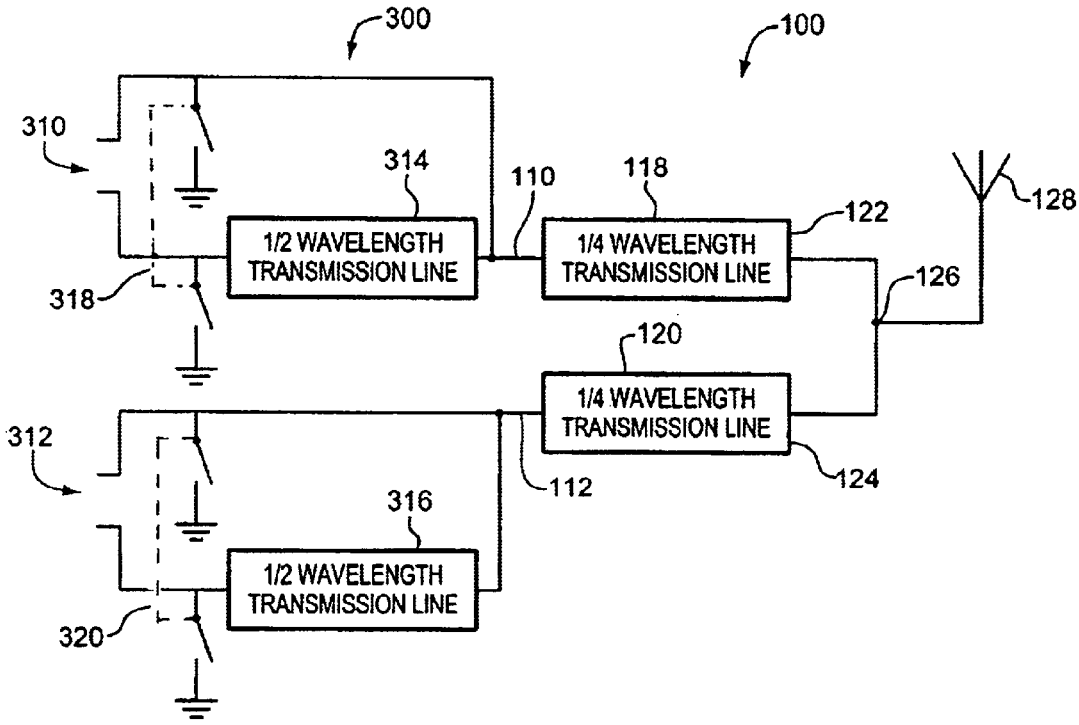
FIG. 3 is a schematic diagram of a combiner that includes a balun for differential receive and transmit ports in accordance with one embodiment of the present invention.

Referring now to FIG. 3, a schematic diagram of a combiner that includes a balun for differential receive and transmit ports in accordance with one embodiment of the present invention will be discussed. As shown in FIG. 3, a balun 300 may be utilized to match differential receive ports 310 and a differential transmit ports 312 to a single input antenna 128. Balun 300 may include half wavelength transmission lines 314 and 316 to match the impedance at differential receive and transmit ports 310 and 312 to combiner 100 and to antenna 128. Balun 300 may include dual shunt admittance elements 318 and 320 across differential receive and transmit ports 310 and 312 to provide isolation of the corresponding differential receive and transmit ports 310 and 312 to ground in a manner similar to the operation of combiner 100 discussed with respect to FIG. 1. In one embodiment of the invention, shunt admittance elements 318 are single throw switches to provide a short circuit to ground for both lines of a corresponding differential receive and transmit ports 310 and 312, although the scope of the invention is not limited in this respect.

Referring now to FIG. 4, a block diagram of a wireless communication system in accordance with one embodiment of the present invention will be discussed. In the communication system 400 shown in FIG. 4, a wireless terminal 410 may include a wireless transceiver 412 to couple to an antenna 128 and to a processor 426. Processor 416 in one embodiment may comprise a single processor, or alternatively may comprise a baseband processor and an applications processor, although the scope of the invention is not limited in this respect. Processor 416 may couple to a memory 414 which may include volatile memory such as DRAM, non-volatile memory such as flash memory, or alternatively may include other types of storage such as a hard disk drive, although the scope of the invention is not limited in this respect. Some portion or all of memory may be included on the same integrated circuit as processor 416, or alternatively some portion or all of memory 414 may be disposed on an integrated circuit or other medium, for example a hard disk drive, that is external to the integrated circuit of processor 416, although the scope of the invention is not limited in this respect.

Wireless terminal 410 may communicate with base station 422 via wireless link 418, where base station 422 may include at least one antenna 420. Base station 422 may couple with a network 426 so that wireless terminal 410 may communicate with network 426, including devices coupled to network 426, by communicating with base station 422 via wireless link 418. Network 426 may include a public network such as a telephone network or the Internet, or alternatively network 426 may include a private network such as an intranet, or a combination of a public and a private network, although the scope of the invention is not limited in this respect. Communication between wireless terminal 410 and base station 422 may be implemented via a wireless local area network (WLAN), for example a network compliant with a an Institute of Electrical and Electronics Engineers (IEEE) standard such as IEEE 802.11a, IEEE 802.11b, and so on, although the scope of the invention is not limited in this respect. In another embodiment, communication between wireless terminal 410 and base station 422 may be implemented via a cellular communication network compliant with a 3GPP standard, although the scope of the invention is not limited in this respect. In one embodiment of the invention, wireless transceiver may include any of the combiners 100 shown in and described with respect to FIGS. 1, 2, and 3, although the scope of the invention is not limited in this respect.

Although the invention has been described with a certain degree of particularity, it should be recognized that elements thereof may be altered by persons skilled in the art without departing from the spirit and scope of the invention. It is believed that the communications subsystem for wireless devices or the like of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof, and further without providing substantial change thereto. It is the intention of the claims to encompass and include such changes.

What is claimed is:

1. An apparatus, comprising:

a first transmission line to couple a single ended receive port to an antenna;

a second transmission line to couple a single ended transmit port to the antenna;

a balun to couple a differential receive port and a differential transmit port to the single ended receive port and the single ended transmit port; and at least one pair of shunt admittance elements to couple to at least one of the differential transmit and the differential receive ports to isolate the at least one of the single ended transmit and the single ended receive ports from the antenna by shunting at least one of the single ended transmit and the single ended receive ports and at least one of the differential transmit and the differential receive ports to ground.

2. An apparatus as claimed in claim 1, wherein at least one of said first and second transmission lines includes a quarter wavelength transmission line.

3. An apparatus as claimed in claim 1, wherein at least one of said first and second transmission lines presents an effective open circuit to the antenna when said at least one pair of shunt admittance element shunts at least one of the transmit and the receive ports to ground.

4. An apparatus as claimed in claim 1, further comprising an impedance transformer coupled to a common junction of said first and second transmission lines to match an impedance of a device coupled to at least one of the differential transmit and the differential receive ports to an impedance of the antenna.

5. An apparatus as claimed in claim 4, wherein said impedance transformer includes a quarter wavelength transmission line.

6. An apparatus as claimed in claim 1, wherein said shunt, admittance element is adapted to provide a shunt admittance at the single ended transmit port sufficient to provide a receiver loss of less than 1 dB.

7. An apparatus as claimed in claim 1, wherein said shunt admittance element is adapted to provide a shunt admittance at the single ended receive port sufficient to provide a transmitter loss of less than 1 dB.

8. An apparatus as claimed in claim 1, wherein said balun includes at least one half wavelength transmission line.

* * * * *